US005211263A

United States Patent [19]

Davidson et al.

[11] Patent Number: 5,211,263

[45] Date of Patent: May 18, 1993

[54] STORE CHECK-OUT STATION

[75] Inventors: Michael B. Davidson; Joseph P. Jackman; Cameron G. Whitworth; Harold Braul, all of Toronto, Canada

[73] Assignee: In-Store Products Limited, Toronto, Canada

[21] Appl. No.: 822,787

[22] Filed: Jan. 21, 1992

[51] Int. Cl.[5] ..... B65G 47/66

[52] U.S. Cl. ..... 186/61; 186/63

[58] Field of Search ..... 186/59-69

[56] References Cited

U.S. PATENT DOCUMENTS

| | | | |
|---|---|---|---|
| 2,776,730 | 1/1957 | Crawford . | |
| 2,893,517 | 7/1959 | Sundberg . | |
| 3,557,907 | 1/1971 | Close | 186/62 |
| 3,990,540 | 11/1976 | Aleshire et al. . | |
| 4,138,000 | 2/1979 | Hartup . | |
| 4,177,880 | 12/1979 | Joseloff | 186/63 |
| 4,386,679 | 6/1983 | Mary | 186/68 |
| 4,401,189 | 8/1983 | Majewski | 186/68 |
| 4,512,540 | 4/1985 | Stroh | 248/95 |
| 4,618,032 | 10/1986 | Woolf | 186/61 |
| 4,792,018 | 12/1988 | Humble et al. | 186/61 |
| 4,953,664 | 9/1990 | Vrooman et al. | 186/61 X |
| 4,963,721 | 10/1990 | Kohno et al. | 186/61 X |
| 5,021,640 | 6/1991 | Muroi | 186/61 X |
| 5,040,636 | 8/1991 | Forsythe et al. | 186/61 |

FOREIGN PATENT DOCUMENTS

| | | | |
|---|---|---|---|
| 225380 | 1/1963 | Austria | 186/59 |

*Primary Examiner*—F. J. Bartuska

[57] ABSTRACT

A store check-out station comprises a working table, an input conveyor, and an offset output conveyor. The top surface of the working table is preferably shaped in the form of a truncated sector of a circle, having its input edge orthogonal to its output edge. The input and output conveyors are elongated transfer beds, preferably gravity roller beds. The longitudinal axis of the output transfer bed is laterally offset from that of the input transfer bed. In a preferred embodiment, adapted for use with grocery cart and container systems, the difference in height between the top surface of the working table and that of the transfer beds is approximately equal to the height of a merchandise container.

27 Claims, 5 Drawing Sheets

STORE CHECK-OUT STATION

BACKGROUND OF THE INVENTION

The present invention relates to check-out stations for supermarkets and the like.

Typical prior art check-out counters comprise a rectangular table having an optical scanner embedded therein for reading bar codes on grocery products, an inline conveyor belt for conveying groceries to the table, and an in-line end table for receiving the checked-out grocery products to be packed into plastic or paper bags. The designs of these prior art check-out counters are utilitarian, but they are not necessarily "ergonomic", from the perspective of either the cashier or the customer, for a number of reasons. In-line check out desks require the cashier to adopt an unnatural arm motion to lift and pass the grocery products over the scanner, which causes fatigue. The specifications of prior art counters such as the height thereof and position of keyboard tend to be fixed, whereas cashiers come in different sizes. These prior art designs require customers to direct their shopping carts down a long narrow "run-way" between adjacent check out counters. Some known designs provide insufficient space for shoppers to unload comfortably the contents of their shopping carts onto the conveyor belt. Also, prior art in-line designs are not well adapted for use with grocery box systems such as that disclosed in the subject applicants' co-pending U.S. application discussed herein below.

SUMMARY OF THE INVENTION

The present invention is a check-out station, with offset transfer beds separated by a shaped working table, which overcomes the above-noted disadvantages associated with prior art check-out counters. In one embodiment, the subject check-out station comprises a working table of pre-selected ergonomic shape having an input edge and an output edge, input conveying means for conveying grocery products towards the working table, and output conveying means for conveying the grocery products away from the working table. The top surface of the working table preferably takes the shape of a truncated quadrant of a circle, whereby its input edge is orthogonal to its output edge. The subject check-out station may also comprise computing means for computing the value of a customer's order, including data input means for inputting the prices of grocery products making up a customer's order and processing means for processing the data inputted by the data input means, and cash handling means for handling cash received from the customers in payment for the order of products.

In a preferred embodiment, the subject check-out station is adapted particularly for use with the shopping cart and container system disclosed in co-pending application Ser. No. 790,056, filed by the subject Applicants on 12 Nov., 1991, comprising a plurality of merchandise containers of pre-selected height releasably securable to a shopping cart for transporting the containers of merchandise within or to and from a store. This preferred embodiment of the subject invention comprises a working table having a top surface of preselected shape having an input edge and an output edge, input conveying means, output conveying means, computing means for computing the value of a customer's order, and cash handling means for handling cash received from the customer. The input conveying means comprises an elongated, generally horizontal elevated transfer bed having a longitudinal axis with a first end adjacent a cart unloading area and a second end adjacent the input edge of the working table. The output conveying means comprises an elongated generally horizontal elevated transfer bed having a longitudinal axis and a first end adjacent the output edge of the working table and second end adjacent a customer reloading area. The longitudinal axis of the output transfer bed is laterally offset from the longitudinal axis of the input transfer bed. The difference in height between the top surface of the working table and the transfer beds is selected to be approximately equal to height of a container.

Because of the shape of the working table, grocery products removed by a cashier from a container located at the output end of the input transfer bed can be processed by moving them across the top surface of the working table in a natural arm motion describing an arcuate path, and placed in a container located at the input end of the output transfer bed, with relative ease. Both the height of the table and the position of the keyboard are adjustable. The offset configuration of the transfer beds of the subject invention eliminates the long, narrow "run-way" between adjacent check-out stations associated with in-line stations, and gives customers more room for loading and unloading groceries. The subject check-out station is thus considered by the Applicants to be a more ergonomic design than prior art check-out stations. The subject check-out station is also well adapted for use with the applicant's shopping cart and container system utilizing a plurality of grocery boxes releasably securable to a shopping cart. Further, the base of the working table is preferably made from concrete, which provides increased stability for sensitive weighing/scanning equipment.

DESCRIPTION OF THE PREFERRED EMBODIMENTS

Figure 1:
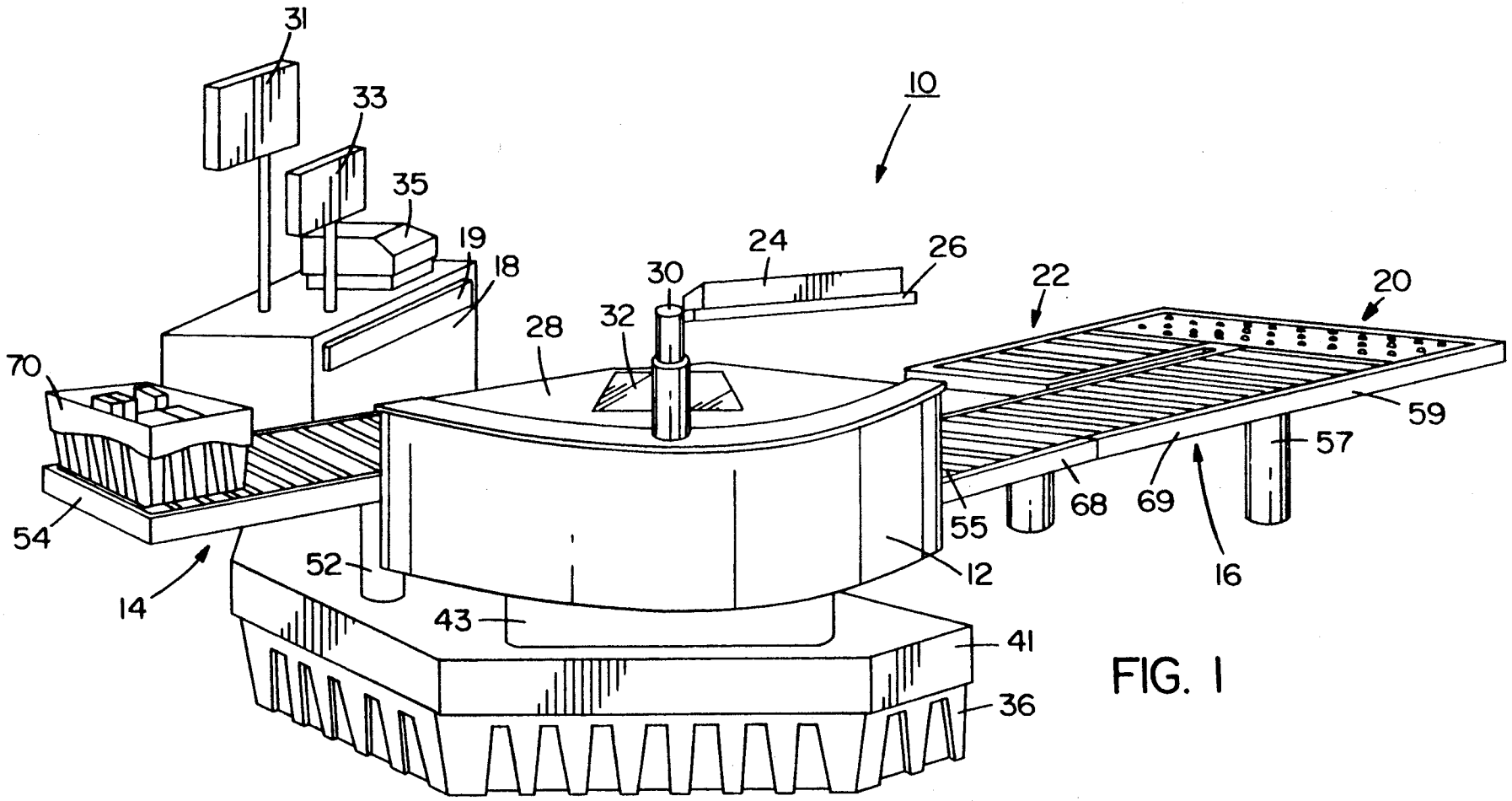
FIG. 1 is a perspective view of a preferred embodiment of the check-out station of the present invention.
Figure 2:
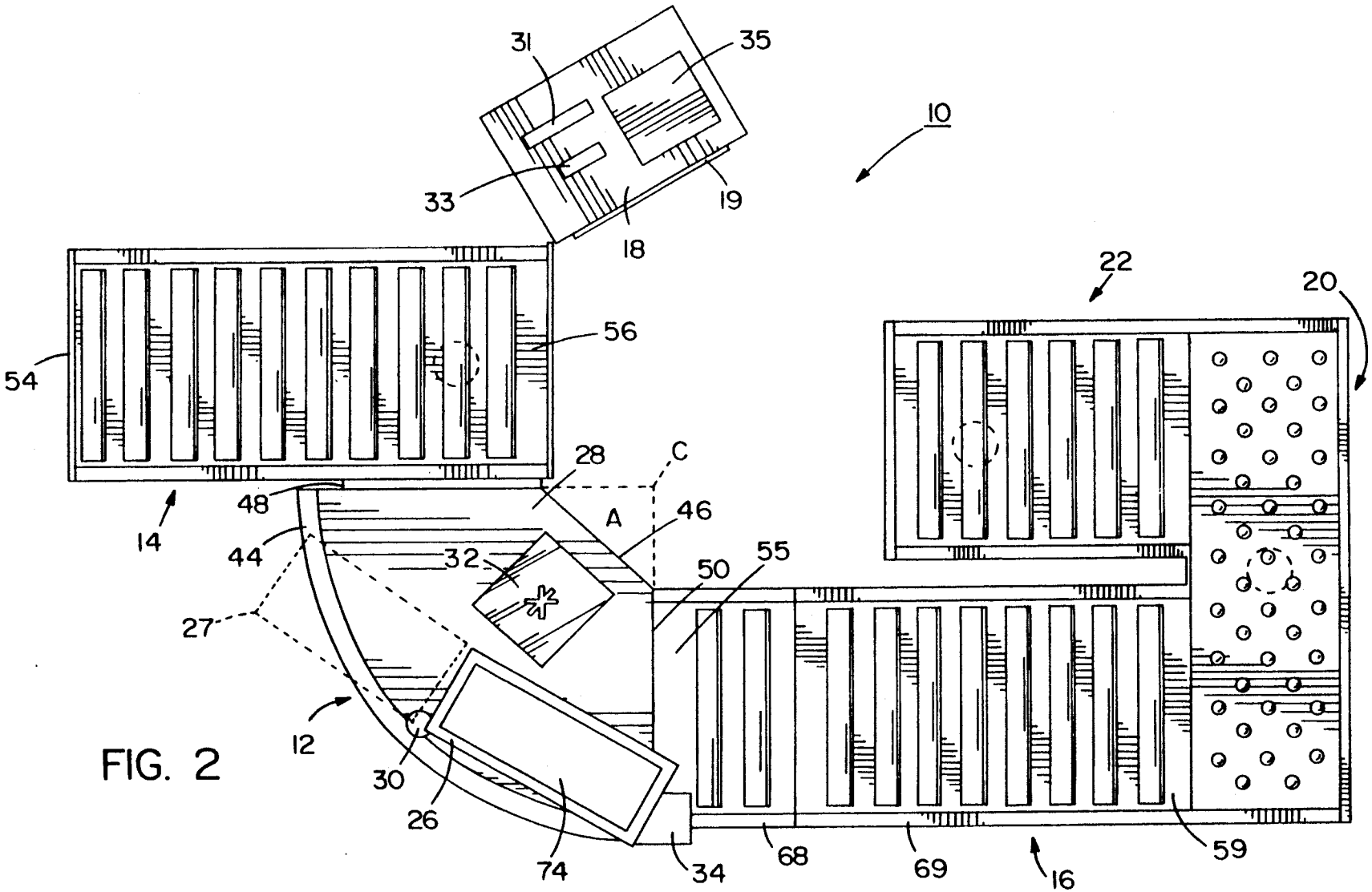
FIG. 2 is a top plan view of the check-out station shown in FIG. 1.

Referring to the drawings, FIGS. 1 and 2 illustrate a preferred embodiment of the check-out station of the present invention, adapted for use with the shopping cart and container apparatus disclosed in applicants's aforementioned co-pending application. Checkout station 10 comprises a central working table 12, an input roller conveyor shown generally as 14, an output roller conveyor shown generally as 16, optional finish table 20, and optional return table 22.

The subject check-out station also comprises computing means for computing the value of a customer's order, and cash handling means for handling cash received from customers in payment of their orders. The computing means comprises data input means for inputting the prices of merchandise making up a customer's order. Such data input means preferably comprises scanner/scale 32 embedded within the top surface 28 of working table 12, and keyboard 24 for manually inputting prices of merchandise mounted on keyboard tray 26 supported above working table 12 by post 30. Scanner/scale 32 may comprise a commercially available combination scanner unit which detects bar codes appearing on many grocery items, and a sensitive scale for weighing produce and other items sold by weight. Keyboard 24 is used to manually input the prices of merchandise which does not include bar codes. The data inputted by scanner/scale 32 and keyboard 24 is processed by a computer processor (not shown) located within cash stand 18. The computer processes the data inputted, and calculates the total cost of a customer's order. The cash handling means comprises a cash drawer 19 located in cash stand 18. Product display 31 and scale readout display 33 project upwardly from cash stand 18. Printer 35 rests on top of cash stand 18. Check-writing ledge 34 extends upwardly from one side of the working table 12.

Figure 3:
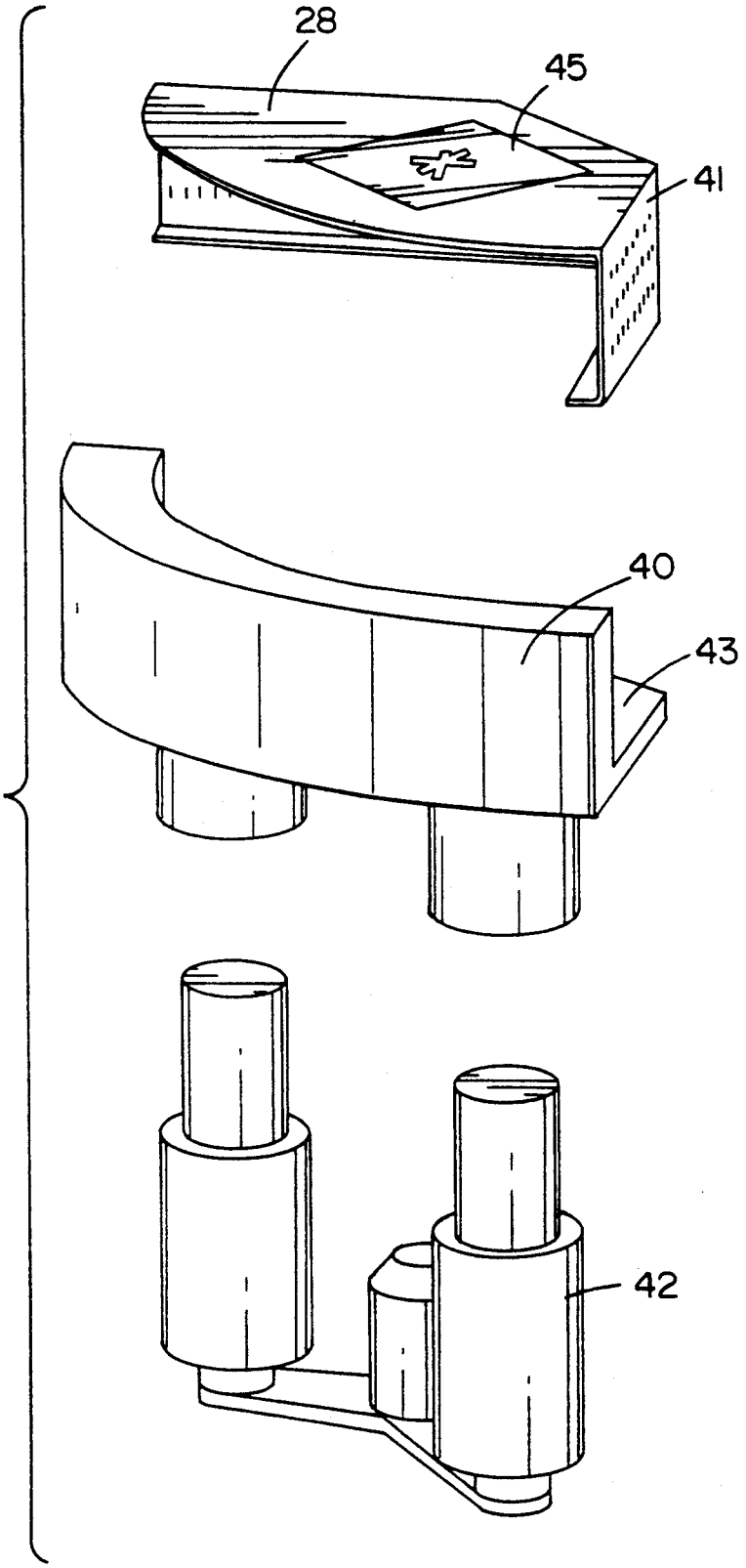
FIG. 3 is an exploded view of the working table of the subject check-out station.

Referring now to FIGS. 1 and 3, base 36 of check-out station 10 is preferably made from concrete filled Kydex (trade mark) plastic forms. Working table 12 preferably comprises a concrete table body 40 mounted on a dual-cylinder lift assembly 42 extending upwardly from base 36. Metal shrouds 41 and 43 cover lift assembly 42. Lift assembly 42 allows the height of working table 12 to be adjusted by up to 4 inches, to suit the preference of the cashier. Table body 40 is generally L-shaped in cross-section, and scale./scanner 32 rests on ledge 43 of table body 40. Table shroud 41 having top surface 28 with a central aperture 45 for accommodating scale/scanner 32 is mounted on ledge 43. Concrete base 36 and table body 40 provide sufficient stability for the sensitive scanner/scale 32 mounted within the top surface 28 of working table 12.

Referring again to FIG. 2, the top surface 28 of working table 12 is arcuate shaped, and in its preferred embodiment, takes the form of an truncated sector of a circle, preferably a quadrant. Top surface 28 has an arcuate outside circumferential edge 44, a straight inside edge 46, a straight input side edge 48, and a straight output side edge 50. Top surface 28 is truncated in the sense that side edges 48, 50 do not meet at the center C of a circle as shown in FIG. 2, but rather triangular section A is truncated by inside edge 46. It is believed by the applicants that this particular shape provides optimum ergonomics, but it will be apparent that variations can be made to the precise shape of the top surface of the working table without falling outside the scope of this invention.

Referring to both FIGS. 1 and 2, input roller conveyor 14 is mounted to base 36 in a cantilevered fashion by lift assembly 52 for raising and lowering roller conveyor 14. Input roller conveyor 14 is preferably set at an angle of about 1° to the horizontal, declining from input end 54 to output end 56. In other words, the input end 54 of roller conveyor 14 is raised slightly above output end 56 of roller conveyor 14, so that containers placed on conveyor 14 near input end 54 will roll gently towards output end 56. Output conveyor 16 is hung onto table body 40 at its entry end 55 and is supported by stationary support 57 at its exit end 59. Output conveyor 16 comprises two .sections 68 and 69. Loading section 68 declines towards working table 12 at about a 2° angle to the horizontal, and exit section 69 declines away from working table 12 at an angle to the horizontal in the range of about 1°-6°.

Figure 4:
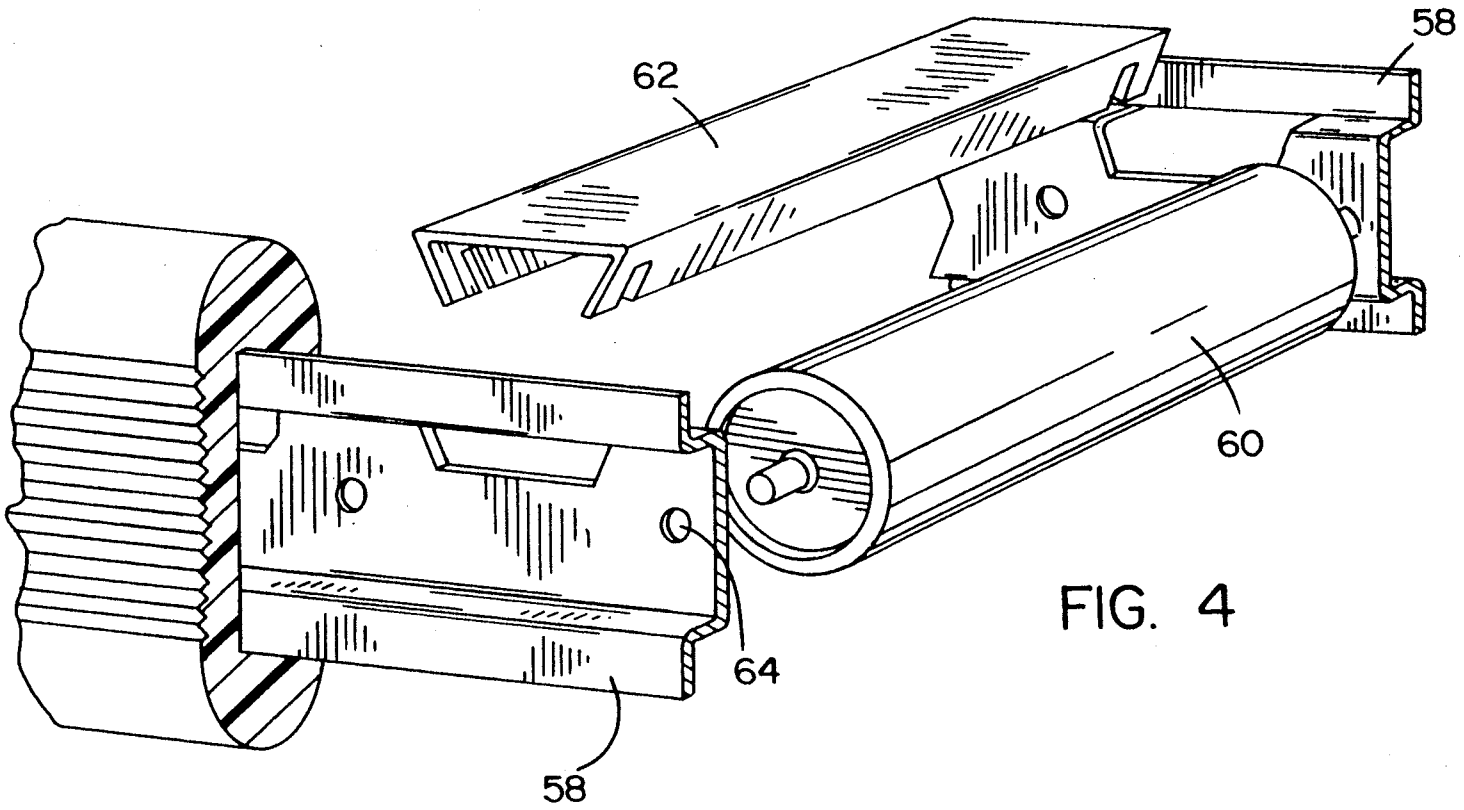
FIG. 4 is a detailed exploded view of a portion of one of the roller beds showing a representative roller and spacer.

Referring now to FIG. 4, input roller conveyor 14 and output roller conveyor 16 both preferably take the form of gravity roller beds each comprising a pair of side frames 58 having a plurality of spaced rollers 60 extending through apertures 64 therein. Spacers 62 are mounted between adjacent rollers 60, to provide a relatively flat top surface while conserving the number of required rollers.

In its preferred embodiment adapted for use with the shopping cart and container apparatus disclosed in aforementioned co-pending application, comprising a shopping cart having releasably secured thereon a plurality of containers, the top surface 28 of working table 12 is selected to be considerably higher than the top surfaces of roller conveyors 14, 16. Preferably, the difference between the top surface 28 of working table 12 and the top surface of roller conveyors 14,16 will be selected to be approximately the same as the height of the containers 70. The length of input roller conveyor 14 is preferably selected to accommodate at least three of containers 70 when they are placed side-ways thereon.

Optional finish table 20 is preferably a rectangular ball-transfer table placed against the exit end 59 of roller conveyor 16. Return table 20 spans both output roller conveyor 16 and optional return table 22. Return table declines away from the finish table 20 at an angle of about 1° to the horizontal, and is supported by stationary support 57.

Figure 5:
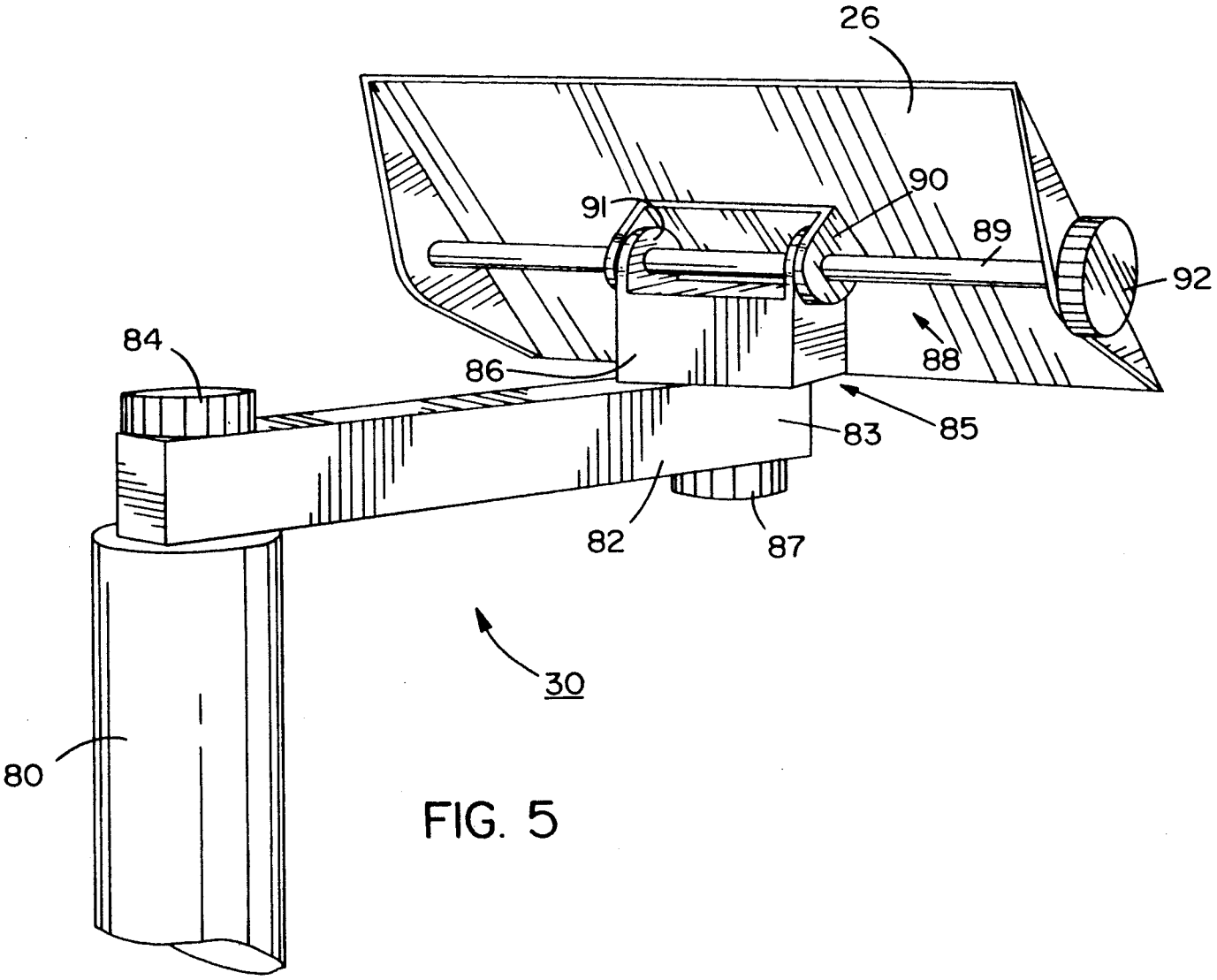
FIG. 5 is a detailed view of the keyboard table and mounting assembly therefor.

FIG. 5 is a detailed view of keyboard tray 26 mounted on stand 30. Stand 30 comprises vertical post 80 and horizontal connecting arm 82 rotatably mounted thereon by means of locking knob 84. Mounted at the free end 83 of connecting arm 82 is keyboard tray rotation means shown generally as 85, comprising swivel block 86 and locking knob 87. Mounted onto swivel block 86 is a tray angle adjustment mechanism shown generally as 88, comprising a rod 89 extending underneath tray 26 through tray lugs 90, lugs 91 on swivel block 86, and locking knob 92. Keyboard tray 26 may be swung 180° from its "right-handed" position shown in FIG. 2, to a "left-handed" position shown by the ghost lines 27 in FIG. 2, and the angle of inclination of keyboard tray 26 may be then adjusted by operation of angle adjustment mechanism 88.

The operation of the preferred embodiment of the subject check-out station, adapted for use with the shopping cart and container apparatus disclosed in applicant's aforesaid co-pending application, will now be described. A customer removes containers of grocery products from a shopping cart and places them on the input end of input conveyor 14, preferably sideways. As each container is placed on input conveyor 14, gravity causes it to roll gently down slightly inclined input conveyor 14 towards the input edge 48 of working table 12. Meanwhile, the cashier takes a corporate "yellow" box from return table 22 and places it onto loading section 68 of output conveyor 16. The cashier then removes the grocery products from the first container located adjacent input edge 48 of working table 12, and passes the products across the scanner/scale 32, and then places them in the yellow box. Once the customer's first container is emptied, and the yellow box is full, the cashier pushes the full yellow box down gently inclined exit section 69 of output roller conveyor 16, and replaces the yellow box with the now empty green box sitting adjacent output edge 48 of working table 12. The cashier then repeats the same process with the customer's second green container, removing each grocery product therefrom, passing the product across the scanner with a natural arm motion, and placing the product in the customer's first green box now located on loading section 68 of output conveyor 16 adjacent output edge 50 of working table 12. This process is then repeated until all of the customers boxes of groceries are processed. When the customer's last green box is emptied, the customer or cashier may then transfer the contents of corporate yellow box into such last green box. The customer may then transfer its green boxes full of groceries back onto a cart, and push the cart to the customer's vehicle to be unloaded therein. The corporate yellow box remains on return table 22, to be used again by the cashier for the next customer's order.

While the preferred embodiment of the subject invention comprises a working table having a height which is considerably greater than the height of the roller beds, for use with the applicant's cart and grocery box system, it will be apparent that the subject invention could be adapted for use with conventional shopping carts not utilizing grocery boxes. For example, the height of the conveyors could be made equal to the height of the working table, and the input conveyor could be provided with an endless electric conveyor belt. While this configuration may not possess all of the advantages of the preferred embodiment, it would still enable the cashier to adopt a more natural arm motion, when passing grocery items over a scanner embedded in the arcuate-shaped working table, thus reducing cashier fatigue.

It will therefore be understood that various changes can be made to the embodiments illustrated and described herein, without departing from the subject invention, the scope of which is defined in the appended claims.

We claim:

1. A check-out station for determining the value of a customer's order merchandise, comprising:

a) a working table having a flat, generally horizontal top surface of pre-selected shape having an input edge and an output edge, wherein the top surface of the working table is generally arcuate shaped;

b) input conveying means for conveying merchandise towards the working table, comprising an elongated, generally horizontal, elevated transfer bed having a longitudinal axis, a first end, and a second end adjacent to the input edge of the working table; and c) output conveying means for conveying the merchandise away from the working table, comprising an elongated, generally horizontal, elevated transfer bed having a longitudinal axis, a first end adjacent the output edge of the working table and a second end spaced therefrom, wherein the longitudinal axis of the output transfer bed is laterally offset from the longitudinal axis of the input transfer bed.

2. The check-out station defined in claim 1, also comprising computing means for computing the value of the customer's order of merchandise, and cash handling means for handling cash received from customers in payment for their orders of merchandise.

3. The check-out station as defined in claim 1, wherein the height of the top surface of the working table is substantially greater than the height of the transfer beds.

4. The check-out station defined in claim 2, wherein the computing means comprises data input means for inputting prices of merchandise, and processing means for processing data inputted by the data input means.

5. The check-out station as defined in claim 4, wherein the data input means comprises indicia detecting means embedded in the top surface of the working table for detecting indicia on merchandise indicative of the price thereof.

6. The check-out station as defined in claim 4, wherein the data input means also comprises a keyboard for manually inputting prices of merchandise.

7. The check-out station as defined in claim 6, wherein the keyboard is mounted to the working table by a tray rotatable about a vertical axis.

8. The check-out station defined in claim 7, wherein the keyboard tray comprises means for rotating the tray about a vertical axis from a position suitable for right-handed cashiers to a position suitable for operation by left-handed cashiers.

9. The check-out station as defined in claim 1, wherein the input transfers bed comprises a gravity roller bed, comprising a plurality of spaced rollers, disposed in a plane slightly inclined to the horizontal, wherein the input end of the roller bed is slightly higher than the output end.

10. The check-out station as defined in claim 9, wherein the gravity roller bed is mounted in a cantilevered fashion.

11. The check-out station as defined in claim 9, wherein the output transfer bed comprises a gravity roller bed, comprising a plurality of spaced rollers disposed in a frame.

12. The check-out station defined in claim 11, wherein a first section of the roller bed adjacent the working table is inclined thereto and a second section of the roller bed is inclined away therefrom.

13. The check-out station as defined in claim 1, wherein the working table is mounted on a concrete base.

14. The check-out station as defined in claim 1, wherein the working table comprises lift means for adjusting the height of the top surface of the working table.

15. The check-out station as defined in claim 1, wherein the input transfer bed include lift means for adjusting the height thereof.

16. The check-out station defined in claim 1, wherein the output conveying means comprises a ball transfer table located adjacent to the output edge of the working table.

17. A check-out station of ruse with a plurality of merchandise containers of pre-selected height releasably securable to a shopping cart adapted for transporting the containers within or to and from a store, comprising:

a) a working table having flat, horizontal top surface of pre-selected shape having an input edge and an output edge, wherein the top surface of the working table is generally arcuate shaped;

b) input conveying means for conveying the containers from a cart unloading area towards the working table, comprising an elongated, generally horizontal transfer bed having a longitudinal axis, a first end adjacent the cart unloading area, and a second end adjacent the input edge of the working table; and c) output conveying means for conveying the containers away from the working table to a cart reloading area, comprising an elongated, generally horizontal elevated transfer bed having a longitudinal axis, a first end adjacent the output edge of the working table, and a second end adjacent a customer reloading area, wherein the longitudinal axis of the output transfer bed is laterally offset from the longitudinal axis of the input transfer bed;

d) wherein the difference in height between the top surface of the working table and the transfer beds is selected to be approximately equal to the height of a container, whereby merchandise removed by a cushion from a container located adjacent the input edge of the working table can be processed by moving the merchandise across the top surface of the working table in a generally arcuate arm motion, and placing the merchandise in a container located adjacent the output edge of the working table.

18. The check-out station defined in claim 17, also comprising computing means for computing the value of merchandise, comprising data input means for inputting prices of merchandise, and processing means for processing data inputted by the data input means and for calculating the total value of a customer's order, wherein the data input means comprises detector means embedded in the top surface of the working table for detecting indicia on merchandise indicative of the price thereof, and a keyboard for manually inputting prices of merchandise.

19. The check-out station defined in claim 18, also comprising cash handling means for handling cash received from customers in payment of an order of merchandise.

20. The check-out station defined in claim 17, wherein the transfer beds are gravity roller beds slightly inclined to the horizontal.

21. A check-out station for determining the value of a customer's order merchandise, comprising:

a) a working table having a flat, generally horizontal top surface of pre-selected shape having an input edge and an output edge, wherein the top surface of the working table is shaped in the form of a truncated sector of a circle;

b) input conveying means for conveying merchandise towards the working table, comprising an elongated, generally horizontal, elevated transfer bed having a longitudinal axis, a first end, and a second end adjacent to the input edge of the working table; and c) output conveying means for conveying the merchandise away from the working table, comprising an elongated, generally horizontal, elevated transfer bed having a longitudinal axis, a first end adjacent to output edge of the working table and a second end spaced therefrom, wherein the longitudinal axis of the output transfer bed is laterally offset from the longitudinal axis of the input transfer bed.

22. The check-out station as defined in claim 21, wherein the sector is a quadrant.

23. A check-out station for determining the value of a customer's order merchandise, comprising:

a) a working table having a flat, generally horizontal top surface of pre-selected shape having an input edge and an output edge, wherein the input edge of the top surface of the working table is generally orthogonal to the output edge of the top surface;

b) input conveying means for conveying merchandise towards the working table, comprising an elongated, generally horizontal, elevated transfer bed having a longitudinal axis, a first end, and a second end adjacent to the input edge of the working table; and c) output conveying means for conveying the merchandise away from the working table, comprising an elongated, generally horizontal, elevated transfer bed having a longitudinal axis, a first end adjacent to output edge of the working table and a second end spaced therefrom, wherein the longitudinal axis of the output transfer bed is laterally offset from the longitudinal axis of the input transfer bed.

24. A check-out station for use with a plurality of merchandise containers of pre-selected height releasably securable to a shopping cart adapted for transporting the containers within or to and from a store, comprising:

a) a working table having flat, horizontal top surface of pre-selected shape having an input edge and an output edge, wherein the top surface of the working table is shaped in the form of a truncated sector of a circle;

b) input conveying means for conveying the containers from a cart unloading area towards the working table, comprising an elongated, generally horizontal transfer bed having a longitudinal axis, a first end adjacent the cart unloading area, and a second end adjacent the input edge of the working table; and c) output conveying means for conveying the containers away from the working table to a cart reloading area, comprising an elongated, generally horizontal elevated transfer bed having a longitudinal axis, a first end adjacent the output edge of the working table, and a second end adjacent a customer reloading area, wherein the longitudinal axis of the output transfer bed is laterally offset from the longitudinal axis of the input transfer bed;

d) wherein the difference in height between the top surface of the working table and the transfer beds is selected to b approximately equal to the height of a container, whereby merchandise removed by a cashier from a container located adjacent the input edge of the working table can be processed by moving the merchandise across the top surface of the working table in a generally arcuate arm motion, and placing the merchandise in a container located adjacent the output edge of the working table.

25. The check-out station defined in claim 24, wherein the truncated portion of the working table has a straight edge.

26. A check-out station for use with a plurality of merchandise containers of pre-selected height releasably securable to a shopping cart adapted for transporting the containers within or to and from a store, comprising:

a) a working table having flat, horizontal top surface of pre-selected shape having an input edge and an output edge, wherein the input edge of the top surface of the working table is generally orthogonal to the output edge of the top surface;

b) input conveying means for conveying the containers from a cart unloading area towards the working table, comprising an elongated, generally horizontal transfer bed having a longitudinal axis, a a first end adjacent the cart unloading area, and a second end adjacent the input edge of the working table; and c) output conveying means for conveying the containers away from the working table to a cart reloading area, comprising an elongated, generally horizontal elevated transfer bed having a longitudinal axis, a first end adjacent the output edge of the working table, and a second end adjacent a customer reloading area, wherein the longitudinal axis of the output transfer bed is laterally offset from the longitudinal axis of the input transfer bed;

d) wherein the difference in height between the top surface of the working table and the transfer beds is selected to be approximately equal to the height of a container, whereby merchandise removed by a cashier from a container located adjacent the input edge of the working table can be processed by moving the merchandise across the top surface of the working table in a generally arcuate arm motion, and placing the merchandise in a container located adjacent the output edge of the working table.

27. A check-out station for use with a plurality of merchandise containers of pre-selected height releasably securable to a shopping cart adapted for transporting the containers within or to and from a store, comprising:

a) a working table having flat, horizontal top surface of pre-selected shape having an input edge and an output edge, and a straight edge between the input and output edges;

b) input conveying means for conveying the containers from a cart unloading area towards the working table, comprising an elongated, generally horizontal transfer bed having a longitudinal axis, a first end adjacent the cart unloading area, and a second end adjacent the input edge of the working table and c) output conveying means for conveying the containers away from the working table to a cart reloading area, comprising an elongated, generally horizontal elevated transfer bed having a longitudinal axis, a first end adjacent the output edge of the working table, and a second end adjacent a customer reloading area, wherein the longitudinal axis of the output transfer bed is laterally offset from the longitudinal axis of the input transfer bed;

d) wherein the difference in height between the top surface of the working table and the transfer beds is selected to be approximately equal to the height of a container, whereby merchandise removed by a cashier from a container located adjacent the input edge of the working table can be processed by moving the merchandise across the top surface of the working table in a generally arcuate arm motion, and placing the merchandise in a container located adjacent the output edge of the working table; and e) wherein the straight edge of the working table defines an angular portion of the working table intersecting with the input and output conveying means.

* * * * *

UNITED STATES PATENT AND TRADEMARK OFFICE

CERTIFICATE OF CORRECTION

PATENT NO. : 5,211,263

DATED : May 18, 1993

INVENTOR(S) : Michael B. Davidson et al.

It is certified that error appears in the above-identified patent and that said Letters Patent is hereby corrected as shown below:

In Column 6, claim 17, line 53, "of ruse" should read --for use--;

In Column 7, claim 17, line 14, "cushion" should read --cashier--; and

In Column 9, claim 26, line 4, "a a" should read --a--.

Signed and Sealed this

Fourth Day of January, 1994

*Attest:*

Bruce Lehman

BRUCE LEHMAN

*Attesting Officer*

*Commissioner of Patents and Trademarks*